US005511922A

United States Patent [19]

Sekiguchi et al.

[11] Patent Number: 5,511,922

[45] Date of Patent: Apr. 30, 1996

[54] SHIP WEIGHT CARGO LOADING AND UNLOADING SYSTEM

[75] Inventors: Goichi Sekiguchi, Tsu; Hisatomo Morito, Tokyo, both of Japan

[73] Assignees: Kayaba Macgregor Navire Kabushiki Kaisha; NKK Corporation, both of Tokyo, Japan

[21] Appl. No.: 258,899

[22] Filed: Jun. 13, 1994

Related U.S. Application Data

[63] Continuation of Ser. No. 930,109, Aug. 13, 1992, abandoned.

[30] Foreign Application Priority Data

Aug. 23, 1991 [JP] Japan ..... 3-212459

[51] Int. Cl.[6] ..... B63B 27/14

[52] U.S. Cl. ..... 414/139.6; 14/71.3

[58] Field of Search ..... 14/71.3, 71.5, 14/71.7; 414/139.6, 139.7, 143.2

[56] References Cited

U.S. PATENT DOCUMENTS 3,846,860 11/1974 Kummerman ..... 414/143.2 X 5,107,781 4/1992 Ebeling et al. ..... 414/143.2 X

FOREIGN PATENT DOCUMENTS 138490 8/1982 Japan ..... 14/71.3

2-66027 3/1990 Japan ..... 414/143.2

3159897 7/1991 Japan .

3-159897 7/1991 Japan ..... 414/139.6

*Primary Examiner*—David A. Bucci

*Assistant Examiner*—Janice L. Krizek

*Attorney, Agent, or Firm*—Jordan and Hamburg

[57] ABSTRACT

This invention relates to a loading and unloading system in a ship wherein a transport car carrying weight cargo enters the ship from an opening in the gunwale via a ramp. The system comprises a lift table which permits the car to board, mechanisms for raising and lowering the lift table disposed at least at the four corners of the table, a ramp of which the near end is selectively supported on the lift table, sensors for detecting the tilt angle of the ramp and the horizontality of the lift table, and a controller for controlling the raising and lowering mechanisms so as to respectively maintain the tilt angle of the ramp and the horizontality of the lift table within set predetermined limits. The tilt of the ramp is thereby maintained within fixed limits irrespective of relative displacements of the ship's hull and the wharf so that the transport car always runs smoothly between the lift table and the wharf.

10 Claims, 11 Drawing Sheets

SHIP WEIGHT CARGO LOADING AND UNLOADING SYSTEM

This application is a continuation of application Ser. No. 07/930,109, filed Aug. 13, 1992, now abandoned.

FIELD OF THE INVENTION

This invention relates to a system used for loading and unloading weight cargo in ships.

BACKGROUND OF THE INVENTION

Weight cargo is usually loaded onto ships by first loading it onto a large pallet, the whole pallet being transported by a transport car to the ship. The car is loaded onto the ship from an opening in the gunwale, and the cargo is then let down into the ship together with the pallet.

To unload cargo from the ship, time car boards the ship in the same way as for loading, receives the cargo together with the pallet, and is then transported onto land.

For this purpose a ramp is provided between the opening in the ship's gunwale and the wharf. As heavy transport cars generally have little capacity to climb hills, the slope of this ramp has to be gentle.

However, the slope of the ramp varies according to various conditions such as the height of the wharf, tide level, draft of the ship and clearance between the wharf and the ship's hull. The tide level changes with time and the draft of the ship changes with the progress of loading/unloading works, hence it is very difficult to maintain the ramp at a constant slope angle so that the transport car can always travel smoothly between the ship and the wharf.

In this context, Tokkai Hei 3-159897 published by the Japanese Patent Office discloses a loading and unloading device wherein a lift table is provided which can rise and fall to permit the transport car to board the ship, and to which one end of the ramp is attached by a hinge. In this arrangement, the slope of the ramp can be adjusted by raising or lowering the lift table.

However, changes in the slope of the ramp are due not only to the conditions above-described but to those which vary more dynamically. For example if the transport car is very heavy, the hull will tend to lean due to the displacement of the car on the ramp, and this too causes a change in the slope of the ramp. As a result, the bent portion of the ramp may scrape the underside of the car or the roof of the car may touch the upper part of the opening in the ship thus obstructing the car's passage, or the underside of the ramp may collide with the wharf and damage the ramp.

Using the aforesaid device, however, it was difficult to adjust the slope of the ramp with the right timing so as to compensate the inclination of the ship's hull due to the displacement of the transport car.

SUMMARY OF THE INVENTION

It is therefore an object of this invention to automatically adjust the slope of a ramp according to the relative height of the opening in a ship's hull and a wharf so that a cargo transport car can always travel smoothly between the hull and the wharf.

It is a further object of this invention to improve the efficiency of transfer of cargo between a ship and a transport car.

In order to achieve the above objects, this invention provides a loading and unloading system which loads and unloads weight cargo between a wharf and a ship provided with a gunwale opening and a deck above this opening by means of a transport car which enters and leaves the ship via this opening. The system comprises a rectangular lift table inside the ship to allow the transport car carrying weight cargo to board from the opening, means for raising and lowering the lift table disposed at least at the four corners of the table, a ramp which extends between the lift table and the wharf, means for supporting the base of the ramp on the lift table, means for detecting the tilt angle of the ramp, means for detecting the horizontality of the lift table, and means for controlling the action of the raising and lowering means so as to respectively maintain the tilt angle of the ramp and the horizontality of the lift table within set predetermined limits.

It is preferable that the supporting means comprises ramp supports projecting horizontally towards the opening from the lift table and pins fitted at the base of the ramp, and that the pins are selectively supported by the ramp supports.

It is also preferable that the control means functions so that if the tilt angle of the ramp moves outside the predetermined limits, two raising and lowering means disposed near the ramp first bring the tilt angle back to within these limits and other raising and lowering means then maintain the horizontality of the lift table within said predetermined limits.

It is also preferable that the raising and lowering means comprises hydraulic cylinders which are supported so that they project above a deck of the ship and can be removed from above.

It is also preferable that the system further comprises lift cables for moving time ramp up and down along the opening, and tilt cables for pivoting the ramp about the hinge.

It is also preferable that time ramp is made to close the opening by driving the lift cables and tilt cables.

It is also preferable that time system further comprises an opening formed in the lift table which allows the passage of a pallet which supports the cargo, a pair of pallet supports arranged facing each other in this opening so as to support the pallet, and hydraulic cylinders which rotate these pallet supports downwards.

It is also preferable that the system further comprises a pair of pallet trucks which move parallel to one another inside the ship hold, platforms provided on the pallet trucks which support the pallet and which rotate about vertical axes, and jacks which lift these platforms.

The details as well as other features and advantages of this invention are set forth in the remainder of the specification and are shown in the accompanying drawings.

DESCRIPTION OF THE PREFERRED EMBODIMENTS

Figure 1:
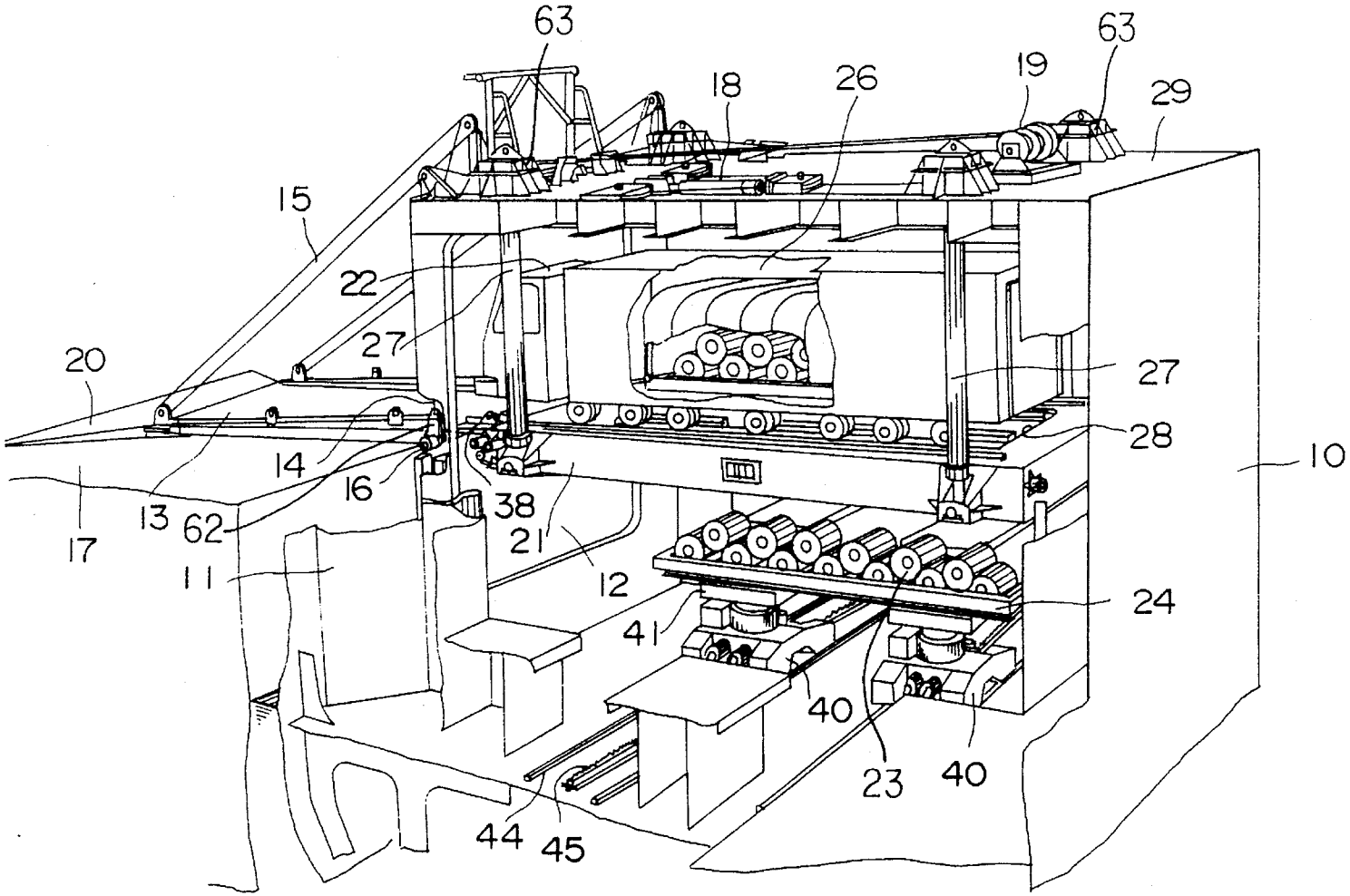
FIG. 1 is a perspective view of a loading and unloading system according to this invention.
Figure 2:
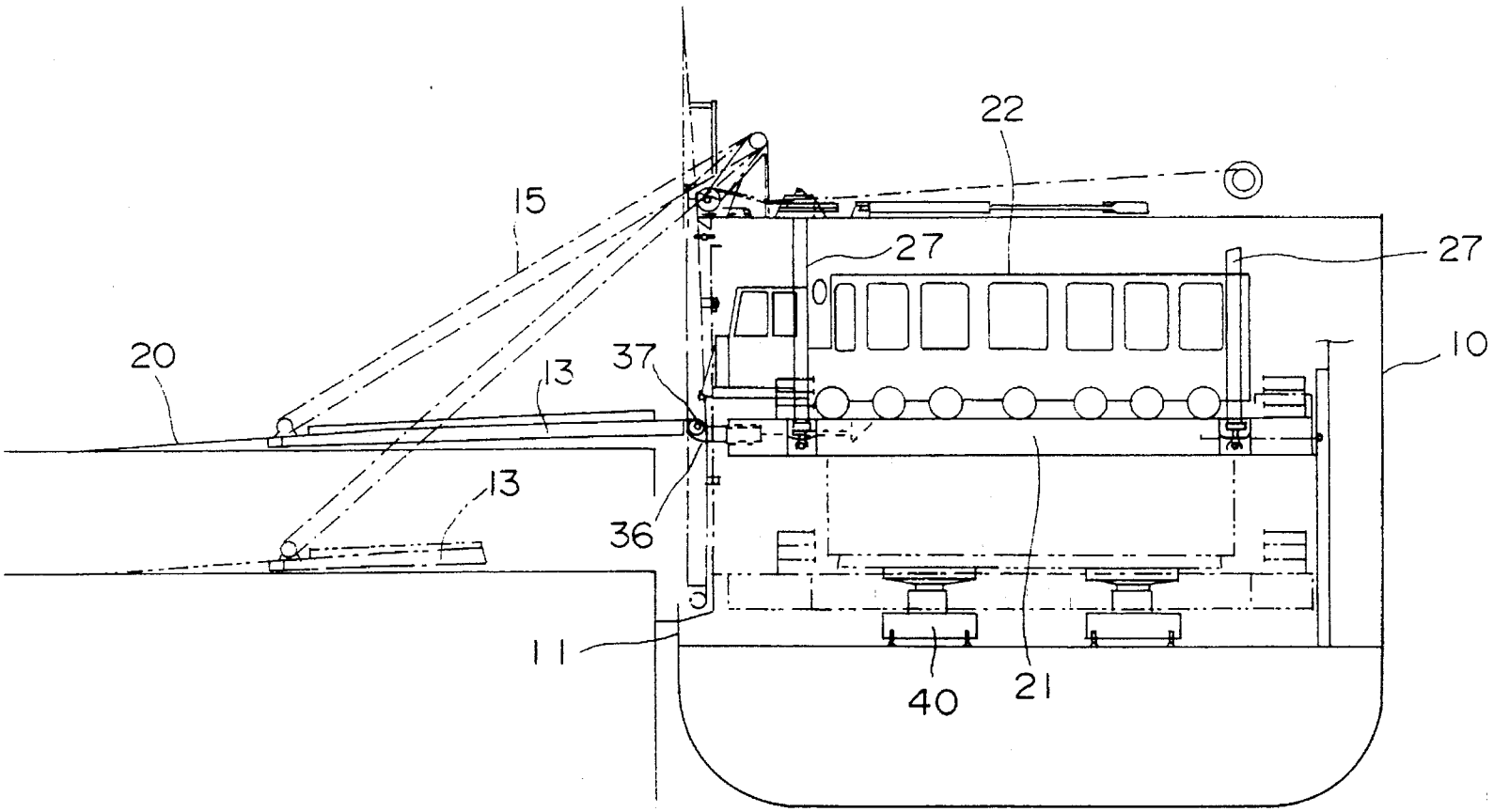
FIG. 2 is a vertical sectional view of the loading and unloading system according to this invention.
Figure 3:
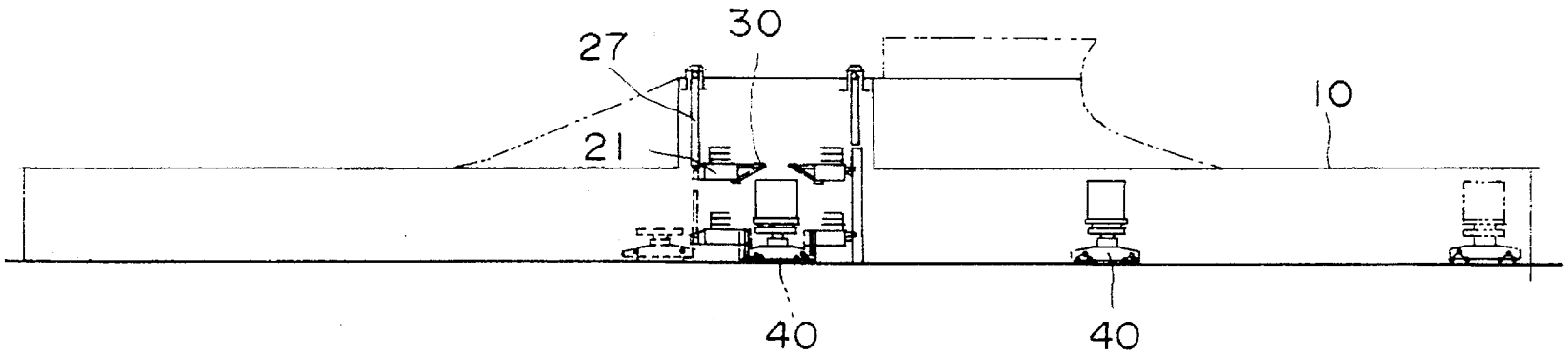
FIG. 3 is a longitudinal sectional view of the loading and unloading system according to this invention.
Figure 4:
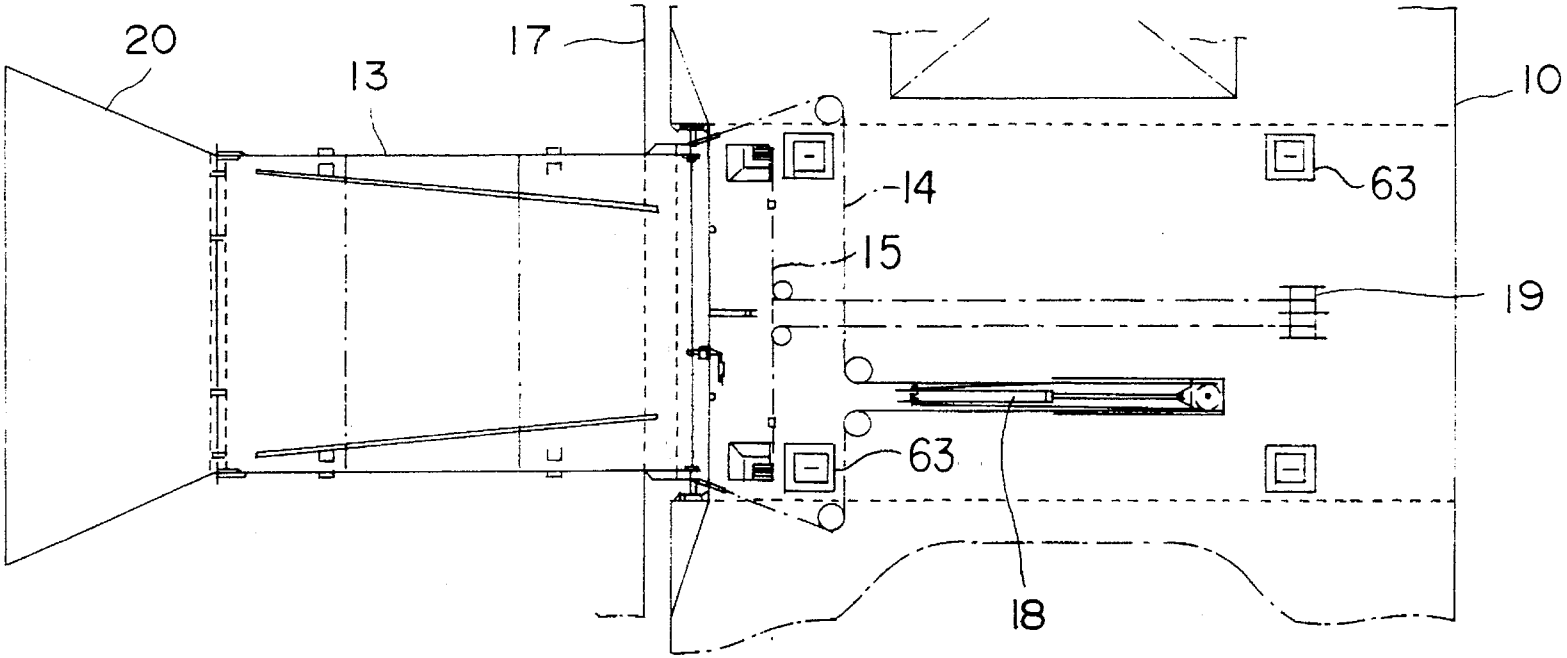
FIG. 4 is a plan view of a ramp according to this invention.

FIG. 1–FIG. 4 show a part of a ship 10 provided with an opening 12 in a right or left gunwale 11 for the purpose of loading and unloading weight cargo. A watertight door which closes this opening 12 when the ship is at sea, functions as a ramp 13 for loading or unloading cargo. The ramp 13 is moved up and down along the opening 12 by lift cables 14 connected to its rear end, and is let down onto a wharf 17 on guide rollers 16 at its near end by tilt cables 15 connected to the far end of the ramp. The guide rollers 16 are received in guides 61 on the ship's hull.

Figure 5:
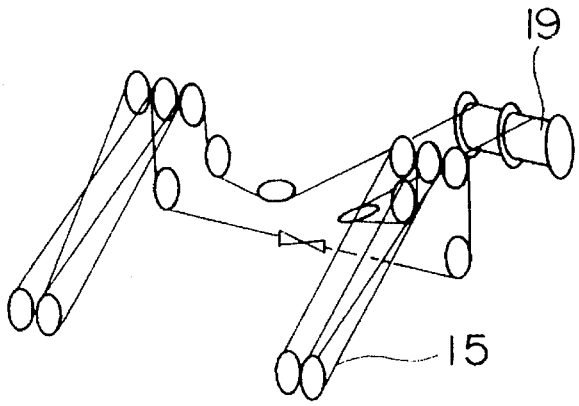
FIG. 5 is a perspective view of a tilt cable system according to this invention.
Figure 6:
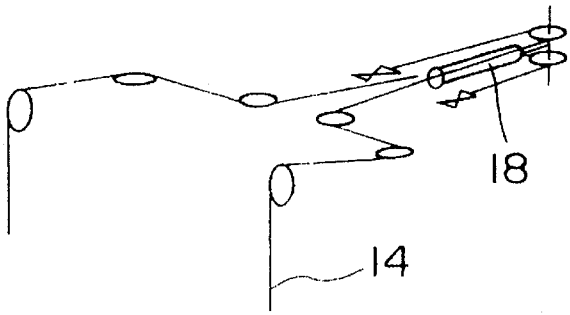
FIG. 6 is a perspective view of a lift cable system according to this invention.

As shown in FIG. 6, the lift cables 14 are tied and pulled by a hydraulic cylinder 18 and as shown in FIG. 5, the tilt cables 15 are tied and pulled by a hydraulic winch 19.

A flap 20 is landed on the wharf 17 at the far end of the ramp 13. This flap, which is free to rotate, distributes the weight of the ramp on the wharf 17 and helps a transport car 22 to travel smoothly from the wharf 17 onto the ramp 13.

As shown in FIG. 1–FIG. 3, and FIG. 7–FIG. 9, the ship 10 is provided with a lift table 21 which rises and falls on the inner side of the opening 12. The lift table 21 is a rectangular table which receives the transport car 22 boarding the ship 10 from the ramp 13, and its width and depth are respectively larger than the width and overall length of the transport car 22.

The transport car 22 transports very heavy cargo such as, for example, thin coil 23, on a pallet 24. The car runs up the ramp 13, and either lets the pallet 24 down onto or receives it from the lift table 21.

For this purpose, the cargo compartment 26 of the transport car 22 opens both rearwards and downwards. Hooks, not shown, are provided on both sides of this downward opening to support the pallet 24. The transport car 22 is also provided with hydraulic cylinders for controlling the height of the cargo compartment 26.

The transport car 22 runs rearwards over the ramp 13 onto the lift table 21. To lower the pallet 24 onto the lift table 21, time hydraulic cylinder is operated to lower the cargo compartment 26 until the pallet 24 is supported by the table 21. The cargo compartment 26 is then lowered a little further until the hooks separate from the pallet 24, and the transport car 22 is withdrawn from the lift table 21 so as to leave the pallet 24 and its cargo on the table 21.

To load the pallet 24 on time lift table 21 onto the transport car 22, time transport car 22 is moved rearwards onto the lift table 21 with its hooks down until the pallet 24 is fully inside time cargo compartment 26, and the cargo compartment 26 is then raised with the hooks underneath the pallet 24 so as to lift the pallet 24 up.

For the purpose of raising and lowering the lift table 21, the table 21 is suspended from an upper deck 29 of the ship 10 via hydraulic cylinders 27 which are connected to the four corners of the table. The upper ends of the cylinders 27 project above the upper deck 29 of the ship 10 so that they can easily be removed or replaced for inspections and maintenance.

These hydraulic cylinders 27 are supplied with drive oil via a controller 50 described hereinafter, so that they simultaneously or separately lengthen or shorten in order to raise or lower the lift table 21.

An opening 28 of sufficient size to allow the pallet 24 to pass through it, is formed in the center of the lift table 21.

Figure 9:
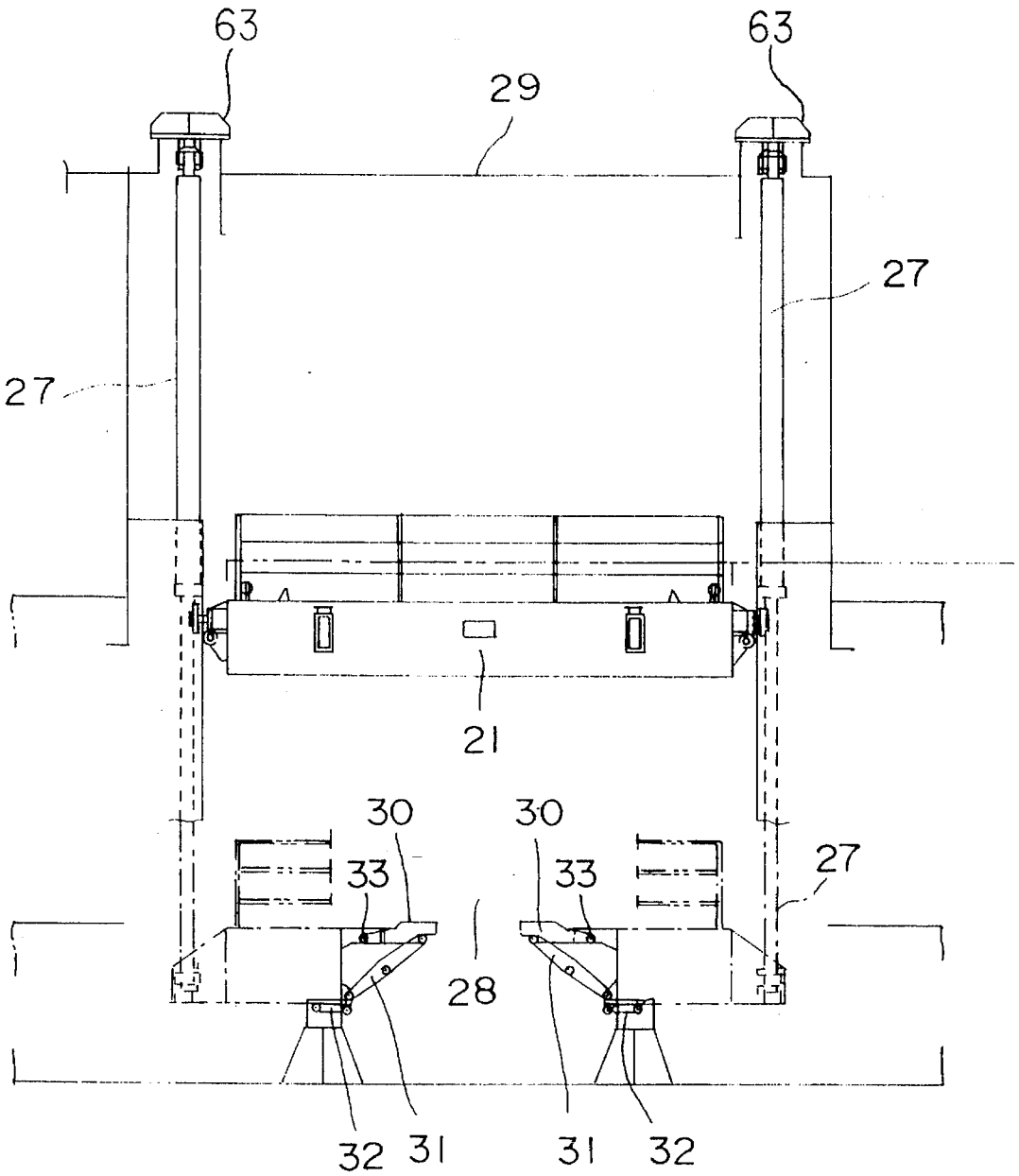
FIG. 9 is a sectional view of the lift table.

A pair of pallet supports 30 which are free to rotate are provided on either side of the longitudinal direction of this opening 28 to receive the pallet 24 which has been lowered down from the transport car 22. As shown in FIG. 9, the pallet supports 30 are made to turn downwards from a horizontal position about hinges 33 by means of drive links 31 and hydraulic cylinders 32 so as to widen the opening 28 and let the pallet 24 down onto a pair of pallet trucks 40 described hereinafter. The supporting surfaces of the pallet supports 30 are set higher than the running surface of the transport car 22 on the lift table 21 to facilitate transfer of the pallet 24 from the transport car 22, and allow the hooks to pass between the pallet 24 and the running surface on the lift table 21 when the empty transport car 22 is moved onto or from the lift table 21 while the pallet 24 is on the lift table 21.

Cut-out holes 34 are formed in the pallet supports 30 so that platforms 41 on the pallet trucks 40 can pass between the pallet supports 30 even when the opening 28 is narrowed by the pallet support 30.

Further, guides 35A are provided on the outer sides of the pallet supports 30 of the lift table 21 so as to correctly position the transport car 22 in relation to the opening 28 as the car boards, and car buffers 35B are also provided to stop the transport car 22 from moving beyond a certain point.

A pair of ramp supports 36 are provided in one side of the lift table 21 facing the opening 12 such that they project horizontally into time opening 12. These ramp supports 36 support pins 37 fitted to the base of the ramp 13 in semicircular stop grooves 36A such that the ramp 13 is free to tilt around the hinge pins 37. Hydraulic cylinders 39 are provided underneath the lift table 21 to drive the ramp supports 36 horizontally. The hinge pins 37 are disposed slightly more towards the inside than the lateral surface of the ramp 13 so that they do not obstruct the ship's hull when the ramp 13 is acting as a watertight door closing the opening 12 of the gunwale 11.

Figure 7:
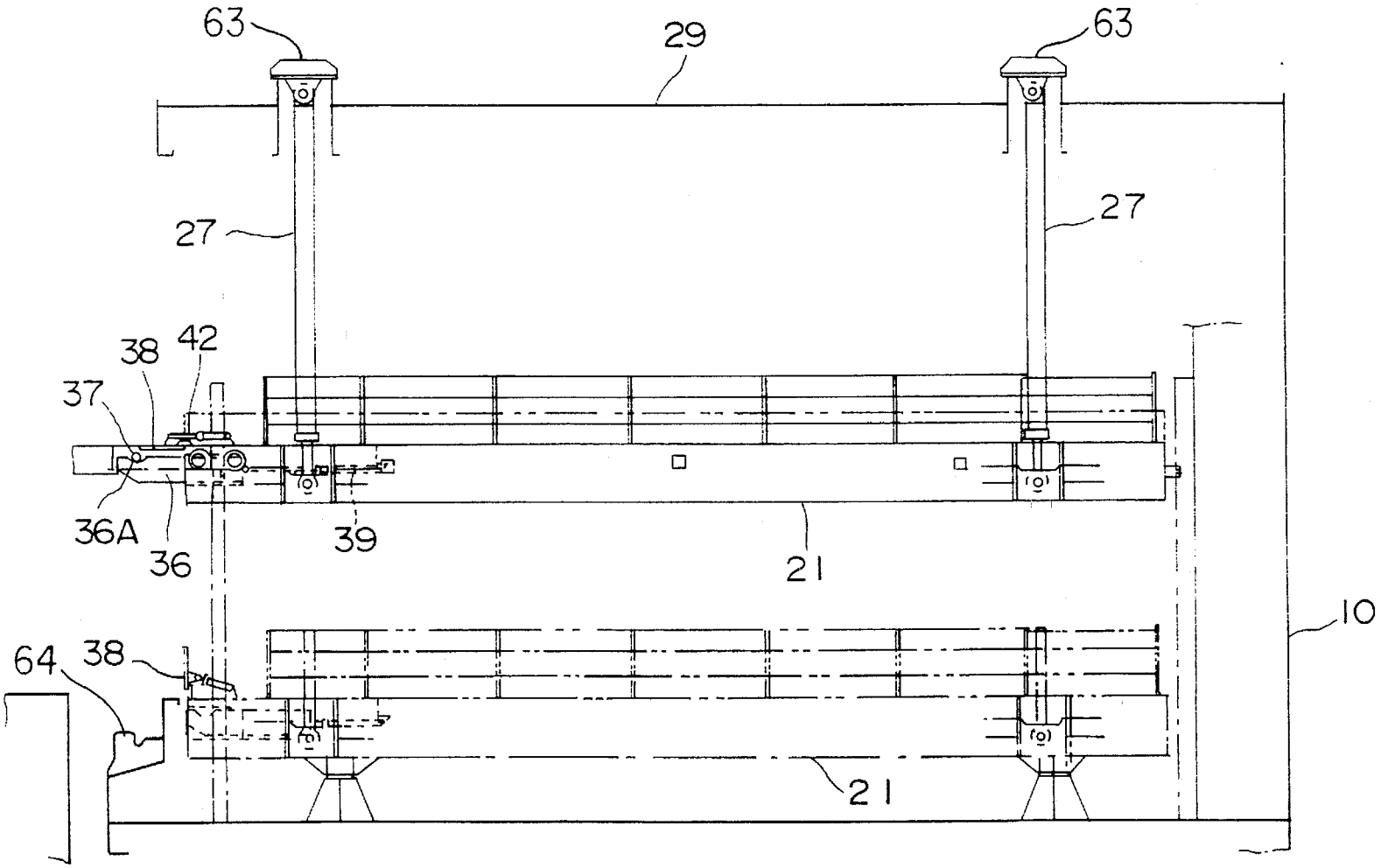
FIG. 7 is a profile view of a lift table according to this invention.
Figure 8:
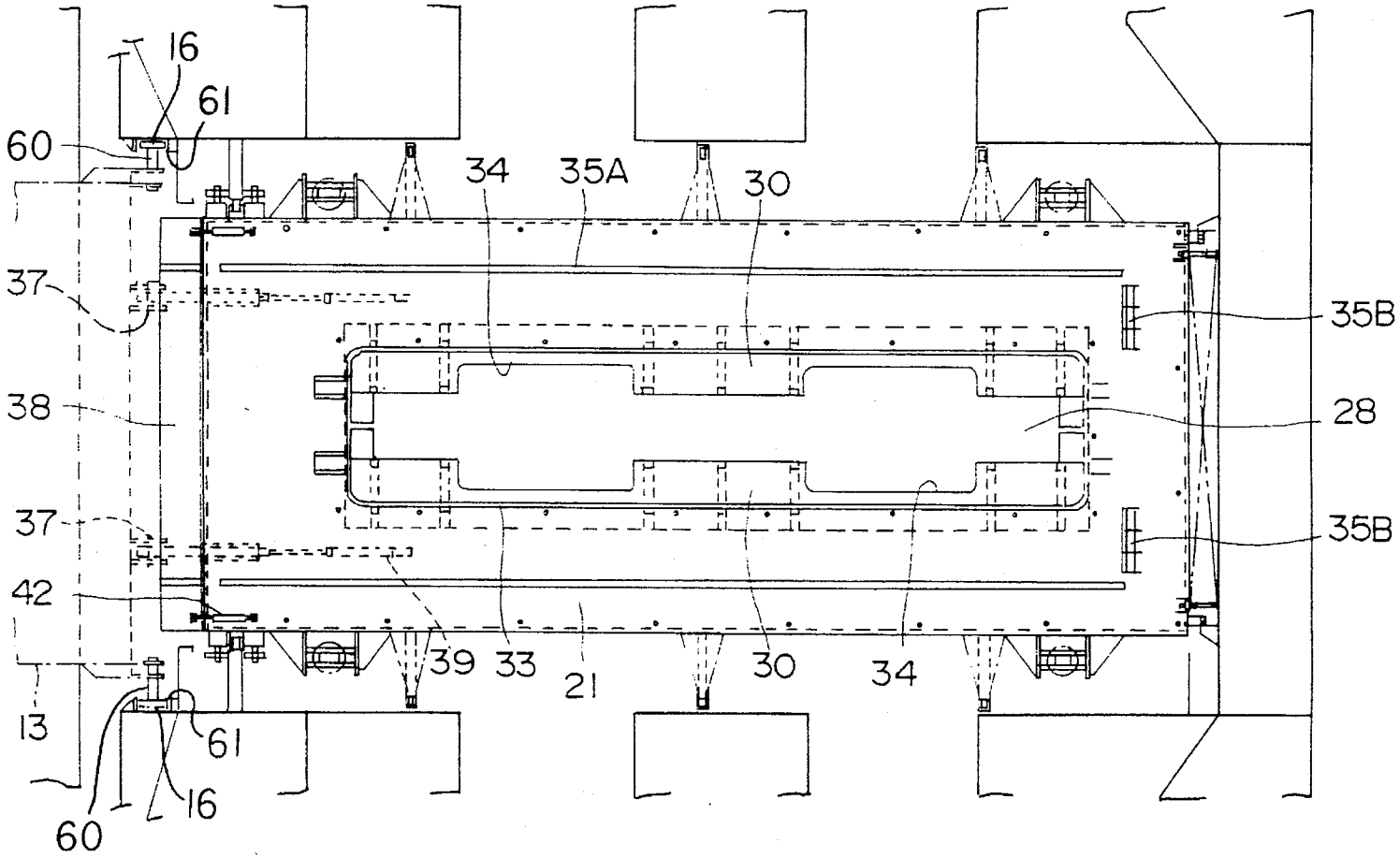
FIG. 8 is a plan view of the lift table.

An auxiliary flap 38 is provided on the lift table 21 which acts as a bridge between the table 21 and the ramp 13 when the ramp 13 is supported by the ramp supports 36. The auxiliary flap 38 is made to rotate between a horizontal position and an erect position as shown in FIG. 7 by means of hydraulic cylinders 42.

As shown in FIG. 1, the aforesaid pair of pallet trucks 40 each runs on two guide rails 44 laid longitudinally in the ship's hull. In this embodiment, there are two pairs of pallet trucks 40 running on the guide rails 44.

Figure 10:
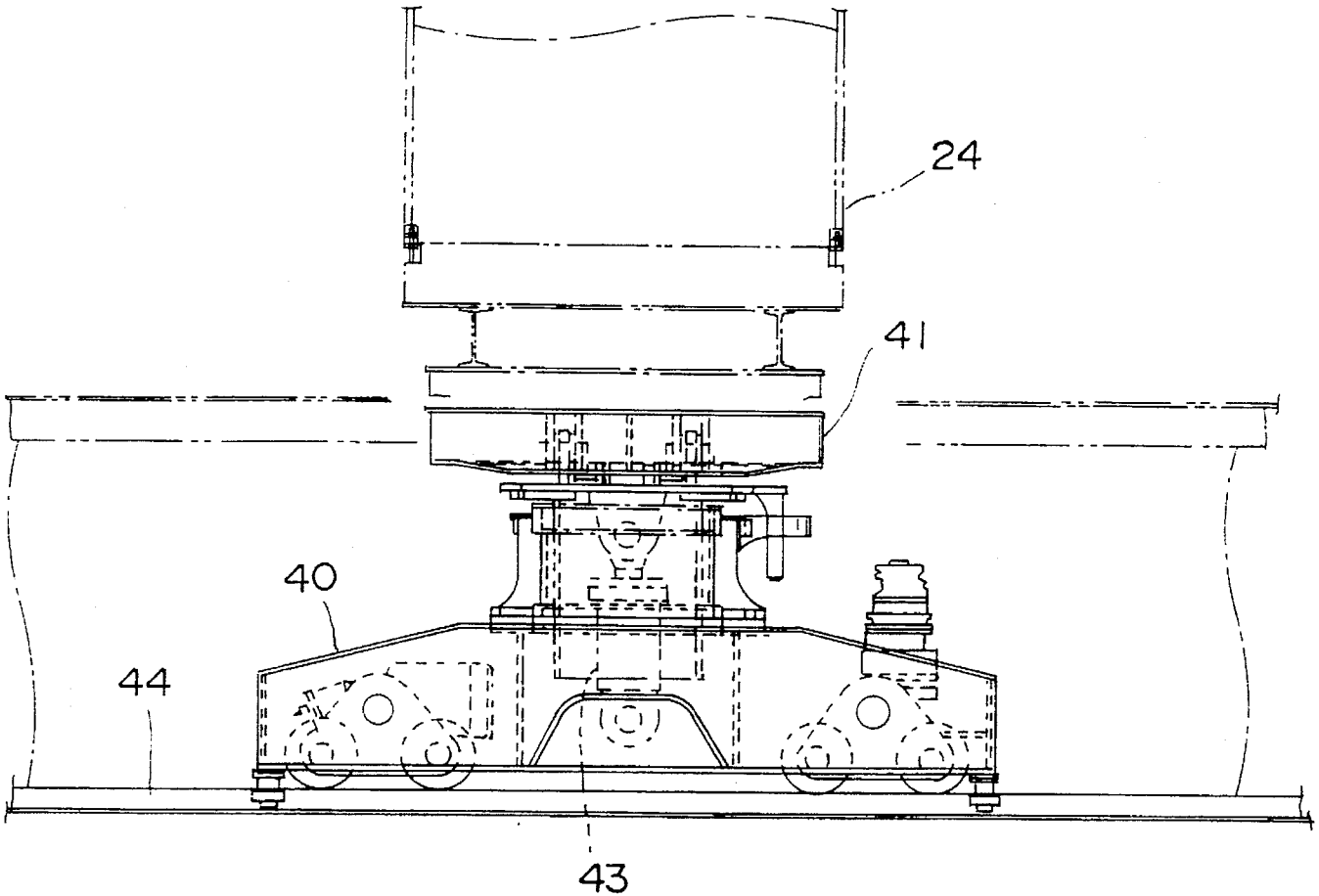
FIG. 10 is a profile view of a pellet truck according to this invention.

As shown in FIG. 10, each pallet truck 40 is provided with a platform 41 which is raised and lowered by a hydraulic jack 43. The pallet 24 is transported between a predetermined storage position and the position directly under the lift table 21 while the left and right of the pallet 24 are supported by these two platforms 41 on the pallet trucks 40.

A pinion, not shown, which is rotated by a hydraulic motor, engages with a rack 45 between the rails 44 so as to synchronize the speeds of the left and right pallet trucks 40.

In order to absorb small differences in the speeds at which these pallet trucks 40 move, the platforms 41 rotate horizontally about the axes of the hydraulic jacks 43. In this way, unnecessary frictional forces are avoided if a small imbalance should occur when the pallet 24 is being transported.

Figure 11:
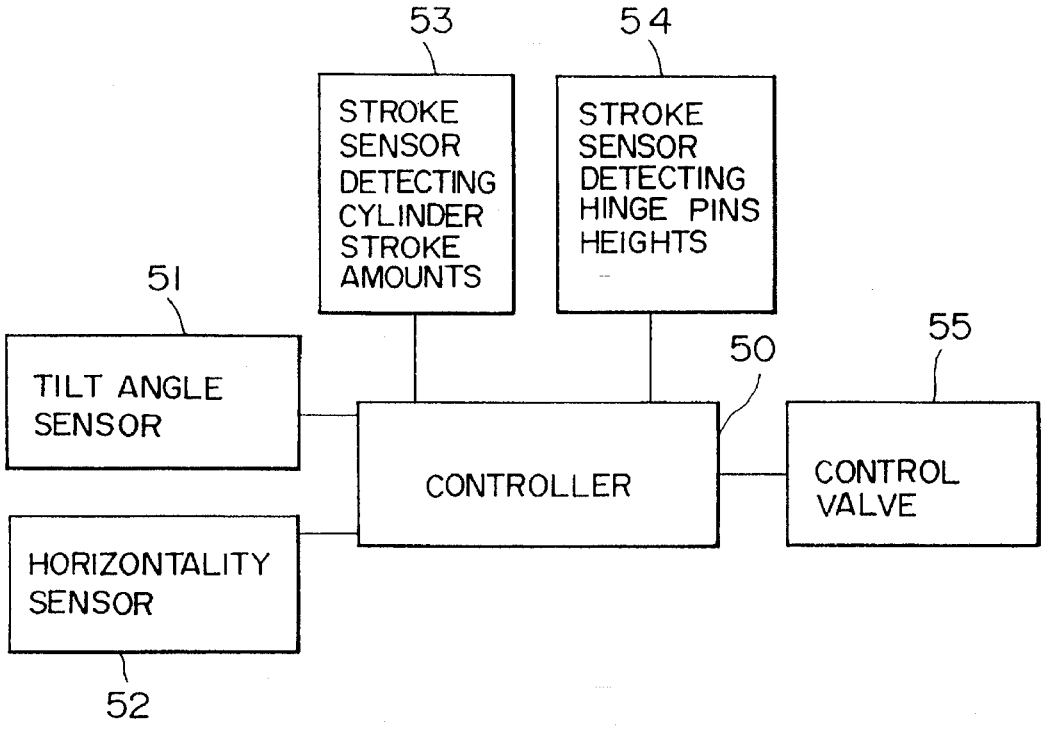
FIG. 11 is a block diagram of a controller according to this invention.

As shown in FIG. 11, to control the rise and fall of the aforesaid lift table 21, and to control the tilt angle of the ramp 13 to within predetermined limits, there are provided a control valve 55 which supplies drive oil to the hydraulic cylinder 27 and a controller 50 which controls the operation of this valve 55.

Also provided are a tilt angle sensor 51 for detecting the tilt angle of the ramp 13, a horizontality sensor 52 for detecting the horizontality (tilt angle) of the lift table 21, stroke sensors 53 for detecting the stroke amounts of the hydraulic cylinders 27, and stroke sensors 54 for detecting the heights of the hinge pins 37 of the ramp 13 from the stroke amount of the hydraulic cylinder 18. The signals from these sensors are input to the controller 50.

When the pallet 24 carrying a weight cargo is to be transferred from the lift table 21 to the pallet trucks 40 or vice versa, the ramp 13 is detached from the lift table 21, and the lift table 21 is raised or lowered to a desired position. This control is performed by detecting the signal outputs from the stroke sensors 53.

When the transport car 22 is to be moved onto the lift table from the wharf 17, on the other hand, the detached ramp 13 is kept slightly steeper than the optimum angle for the transport car 22 to board, and the positions of the hinge pins 37 at that time are detected by the stroke sensors 54. The lift table 21 is then raised or lowered such that the ramp supports 36 are at a slightly lower height than that of the hinge pins 37, and the ramp supports 36 are made to project from the opening 12. Then the base of the ramp 13 is lowered until the hinge pins 37 are supported by the stop grooves 36A of the supports 36.

The stroke amounts of the hydraulic cylinders 27 are then adjusted based on signals from the tilt angle sensor 51 and the horizontality sensor 52 so that the tilt of the ramp 13 is kept within optimum predetermined limits for the boarding of the transport car 22, and the lift table 21 is kept at a predetermined horizontal position.

Figure 12:
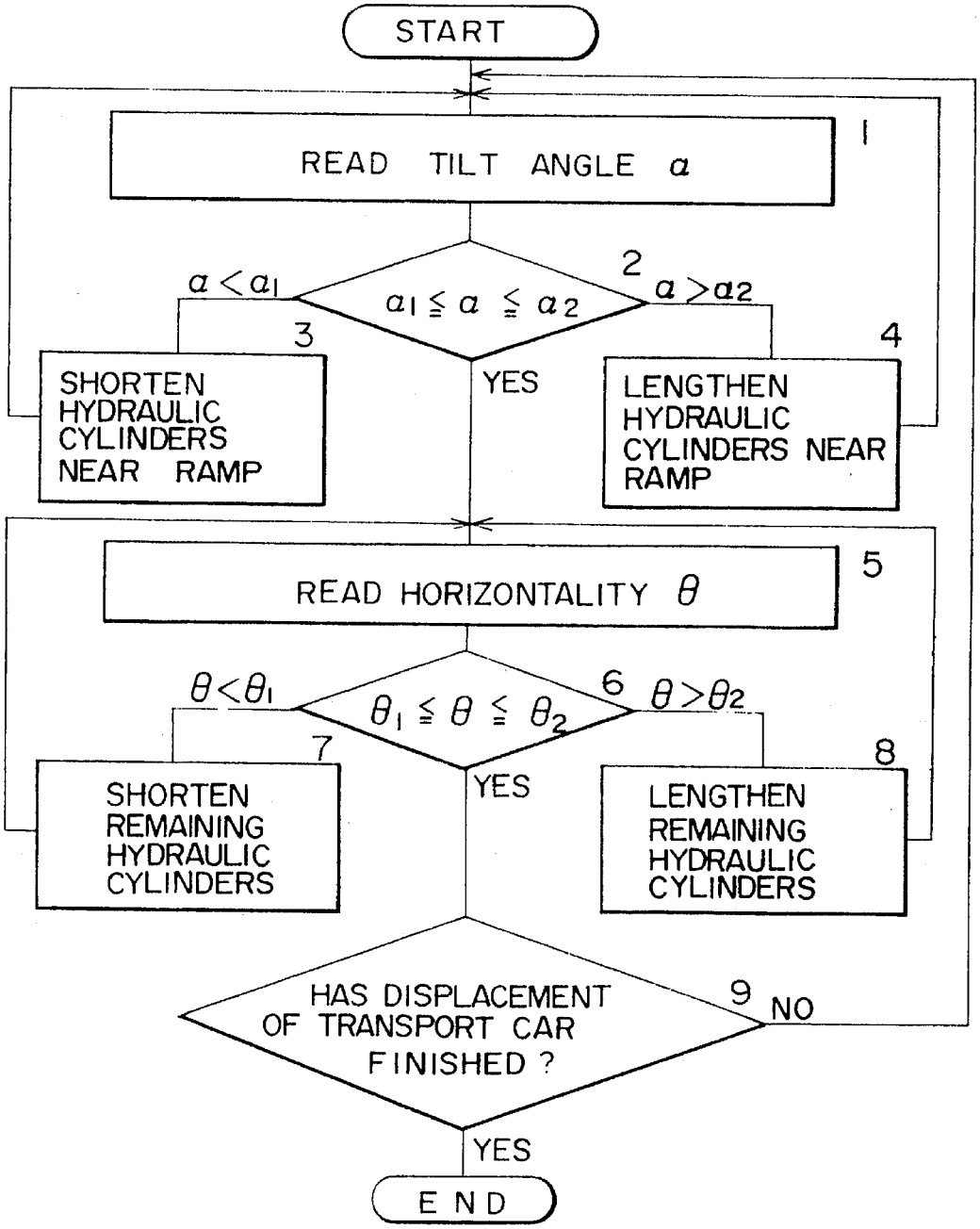
FIG. 12 is a flowchart showing how the tilt angle of the ramp and lift table is controlled.

The tilt angle control of the ramp 13 and the horizontality control of the lift table 21 are performed according to the flowchart of FIG. 12.

First, in Steps 1 and 2, the tilt angle a of the ramp 13 is read, and it is judged whether or not this is within predetermined limits, i.e. whether or not $\alpha_1 \leqq \alpha \leqq \alpha_2$. These tilt angle limits a $\alpha_1$ and $\alpha_2$ are minimum and maximum angles at which the transport car 22 carrying weight cargo can move safely and smoothly on the ramp 13.

If $\alpha$ is less than $\alpha_1$, the two hydraulic cylinders 27 near the ramp are shortened; conversely, if $\alpha$ is greater than $\alpha_2$, these two cylinders 27 are lengthened. In this way, $\alpha$ is brought within the predetermined angle tolerance (Steps 3, 4).

If the tilt angle $\alpha$ of the ramp 13 is within these predetermined limits, the program proceeds to a Step 5 where the horizontality $\theta$ of the lift table 21 (a tilt angle in the same direction as that of the ramp 13) is read. In a Step 6, it is judged whether this angle is within predetermined limits, i.e. whether $\theta_1 \leqq \theta \leqq \theta_2$.

Within these limits, the lift table 21 is substantially horizontal and the transport car 22 can board the ship smoothly. If $\theta$ is less than $\theta_1$, the two rear hydraulic cylinders 27 (i.e. not those near the ramp 13) are shortened. Alternatively, if $\theta$ is greater than $\theta_2$, these two cylinders 27 are lengthened. The horizontality is thereby adjusted to within the permitted limits (Steps 7, 8).

The two hydraulic cylinders 27 near the ramp 13 are lengthened or shortened so as to adjust the tilt angle of the ramp 13. However, this also causes the horizontality of the lift table 21 to vary, therefore the other two hydraulic cylinders 27 are lengthened or shortened to adjust the horizontality of the lift table 21 after adjusting the tilt angle of the ramp 13.

These adjustments are repeated until the transport car 22 has come completely to rest as in a Step 9.

The tilt angle of the ramp 13 varies depending on the boarding status of the transport car 22. By performing adjustments on the tilt angle of the ramp 13 in the aforesaid process, however, the optimum tilt of the ramp 13 can be maintained continually, and the horizontality of the lift table 21 can be maintained within predetermined limits.

Next, the operation will be described whereby the pallet 24 and stored cargo in the ship 10 are unloaded from the ship 10 to the wharf 17.

First, the door which also functions as a ramp 13 is released. The lift cables 14 are operated so that the base hinge point of the ramp 13 is at a height of for example, approx. 1 m greater than that of the wharf 17, and the tilt cables 15 are operated so that the flap 20 at the end of the ramp 13 is let down onto the wharf 17. The tilt of the ramp 13 is then substantially within the predetermined limits. This procedure is carried out by visual inspection and manual operations.

Next, the lift table 21 which is at its highest position when the ship is at sea, is lowered by a specified amount below the height of the ramp 13 on the hull side and then the ramp supports 36 are projected into the opening 12. The lift cables 14 are slackened so as to lower the ramp 13, and after receiving the hinge pins 37 on the ramp supports 36, the cables 14, 15 are further slackened so that the weight of the ramp 13 is fully supported by the ramp supports 36. The maximum allowable tilt angle of the ramp 13 is then set to approx. 3.5 degrees. These operations are automatically performed in sequence by pressing a START button attached to the controller 50 which is per formed by the operator of the system. The auxiliary flap 38 is also extended horizontally so that there will be no obstruction to the passage of the transport car 22, and preparations for the boarding of the transport car 22 are thereby completed.

Normally, one pallet 24 is carried on the pallet supports 30 of the lift table 21 to fully utilize the space in the ship 10 when it is at sea.

When the transport car 22, which has been standing by on the wharf 17, boards the ramp 13, the ship's hull leans under the car's weight and the tilt angle of the ramp 13 changes. This tilt angle varies with the position of the transport car 22 on the ramp 13. However, as described hereintofore, if the tilt angle of the ramp 13 shifts outside the predetermined limits, the stroke of the two hydraulic cylinders 27 near the ramp 13 lengthens or shortens so as to maintain the tilt angle within these limits. The horizontality of the lift table is also controlled by the lengthening and shortening of the two remaining hydraulic cylinders 27 so as to maintain it within the predetermined limits.

The transport car 22 stops just before the pallet 24 on the lift table 21, and the hooks are lowered to the level of the underside of the pallet 24. The car then moves forward to the list table 21 until the pallet 24 is completely inside the cargo compartment 26. The hooks are raised, and the transport car 22 with the pallet 24 then moves frontwards down the ramp away from the ship 10.

There is a bent portion between the lift table 21 and the ramp 13. If the bending angle of this portion varies when the hooks are moved forward underneath the pallet 24 as the transport car 22 boards the lift table 21, when they let the pallet 24 down and withdraw from it or when the car carrying the pallet 24 moves onto the ramp 13 from the lift table 21, the pallet 24 may strike the hooks or the underside of the car 22 may come into contact with the ramp 13. This would interfere with the smooth motion of the transport car 22 and the reception of the pallet 24.

In the aforesaid control process, however, as the tilt angle of the ramp 13 and the horizontality of the lift table 21 are continually fed back correctly to within the desired limits, this type of disadvantage does not arise. The pallet 24 is therefore always loaded and unloaded safely and smoothly.

When the operator has verified that the pallet 24 has been transported away from the lift table 21, he presses the START button again to begin the next automatic sequence. In this case, the reverse procedure to the above is followed. The link between the ramp 13 and the lift table 21 is temporarily broken, the auxiliary flap 38 is raised, the base of the ramp 13 is raised by the lift cables 14, and the ramp supports 36 are withdrawn. The base of the ramp 13 is then raised to a standby position.

The lift table 21, which is now empty, is also moved to a standby height such that it does not present an obstruction when the pallet trucks 40 carrying a pallet 24 move underneath it.

The pallet 24 nearest the lift table 21 is transported underneath the table 21 by the pallet trucks 40. The speeds of the left and right pallet trucks 40 are synchronized during this movement, but if a small discrepancy should arise between them, it is absorbed by the rotation of the platforms 41 about their vertical axes so as to slightly adjust the position of the pallet 24. The next pallet trucks 40 then carry pallets 24 to a standby position near the lift table The pallet supports 30 of the lift table 21, which is in the raised position, are folded back to widen the opening 28 so that the pallet 24 can pass through it. When the lift table 21 is lowered to its lowest position, the pallet supporting surfaces of the pallet supports 30 are situated below the undersurface of the pallet 24 on the pallet trucks 40.

The pallet supports 30 are rotated until they are horizontal, and the platforms 41 are lowered by the hydraulic jacks 43 of the pallet trucks 40. As the platforms 41 are lowered, the pallet 24 is transferred to the pallet supports 30. The platforms 41 pass through the cut-out holes 34, and therefore do not interfere with the pallet supports 30.

After the lift table 21 receives the pallet 24, the hydraulic cylinders 27 are shortened simultaneously so as to raise the table 21 to time predetermined loading/unloading position.

The ramp 13 is then again linked to the lift table 21, the transport car 22 is brought in, and the pallet 24 is transferred to the transport car 22 which removes it via the ramp 13 as described hereintofore.

After the lift table 21 has risen, the empty pallet trucks 40 withdraw from beneath the lift table 21 to a position where they do not interfere with the other pallet trucks 40 which then move from the standby position to beneath the lift table 21.

By repeating the above procedure, pallets 24 carrying weight cargo stored in the ship 10 are successively removed and unloaded.

In order to load pallets 24 from the wharf 17 to the ship 10 the reverse procedure is basically followed.

First, the ramp 13 is let down to a predetermined tilt angle, time transport car 22 carrying a pallet 24 is brought on board the ship 10, the pallet 24 is lowered onto the pallet supports 30 of the lift table 21, and the transport car 22 is withdrawn. The ramp 13 is then disconnected, and the lift table 21 is lowered to its lowest position.

As the lift table 21 is lowered, the platforms 41 of the pallet trucks 40 which have been brought directly beneath the lift table 21, are raised so that the pallet 24 is transferred from the pallet supports 30 to the platforms 41. The pallet supports 30 are then folded back, and the empty lift table 21 is raised to the aforesaid standby height. The ramp 13 is reconnected to permit the transport car 22 to board, the loaded pallet trucks 40 move to the storage area, and the next pallet trucks 40 which have been at the aforesaid withdrawal position then move beneath the lift table 21. Pallets 24 carrying weight cargo are thereby loaded on the ship 10.

The aforesaid ramp 13 also functions as a watertight door which closes the opening 12. When the ship 10 is at sea, it is stored in a vertical position as shown by the dotted line in FIG. 2, however as its end is allowed to project above the upper deck 29, it therefore has sufficient length to form an inclined passageway with the predetermined tilt angle. In this vertical position, the pins 37 are received in grooves 63 in a hull member 64 provided on the hull of the ship.

The tilt of the ramp 13 connected with the lift table 21 is freely adjusted by the lift table 21. Even if the height is above the wharf 17, the amount of the weight cargo or the tide level changes, and therefore, the ramp 13 can be continually maintained at the optimum tilt angle.

When the ramp 13 is disconnected from the lift table 21, on the other hand, the base of the ramp 13 is raised to a maximum tilt angle of approx. 6 degrees and left on standby. During standby, the relative height of the wharf 17 and the ship's hull changes due to a change in the tide level. When the link between the ramp 13 and the lift table 21 is re-established, however, the maximum tilt angle is set to an optimum angle of approx. 3.5 degrees. Fluctuations during standby are thereby absorbed, and the new height becomes the next loading/unloading position.

To raise and lower the lift table 21, roller chains or ropes may be used instead of the four hydraulic cylinders 27. In such a case, two raising and lowering devices near the opening in the ship's hull and two raising and lowering devices on the opposite side of the lift table 21 may be set such that they can be controlled independently of one another.

This invention is not limited to the above embodiments, various modifications being possible by those skilled in the art without departing from the scope of the claims appended thereto.

The embodiments of this invention in which an exclusive property or privilege is claimed are as follows:

1. A loading and unloading system which loads and unloads cargo between a wharf and a ship provided with an opening and a deck by means of a transport car which enters and leaves the ship via said opening, said system comprising:

a rectangular lift table inside the ship to allow said transport car carrying cargo to board through said opening, means for raising and lowering said lift table disposed at least at the four corners of said table, a ramp which extends between said lift table and said wharf, said ramp having a base, supporting means for supporting the base of said ramp on said lift table, first detecting means for detecting the tilt angle of said ramp, said first detecting means having an output, second detecting means for detecting the horizontality of said lift table, said second detecting means having an output, and control means receiving said output from said first and second detecting means for controlling the action of said raising and lowering means so as to respectively maintain the tilt angle of said ramp and the horizontality of said lift table within set predetermined limits as the relative position between the ship and the wharf changes.

2. A loading and unloading system as defined in claim 1, wherein said supporting means comprises extendable ramp supports on said lift table and extendable horizontally from said lift table towards said opening, and pins fitted at the base of said ramp, said pins being supported by said extendable ramp supports.

3. A loading and unloading system as defined in claim 1, wherein said control means functions so that if the tilt angle of said ramp moves outside said predetermined limits, two of said raising and lowering means disposed near the ramp first bring the tilt angle back to within these limits and another two of said raising and lowering means then maintain the horizontality of the lift table within said predetermined limits.

4. A loading and unloading system as defined in claim 1, wherein said raising and lowering means comprises hydraulic cylinders supported by said deck of the ship, said deck having holes for installation and removal of said cylinders.

5. A loading and unloading system which loads and unloads cargo between a wharf and a ship provided with an opening by means of a transport car which enters and leaves the ship via this opening, said system comprising:

a rectangular lift table inside the ship to allow said transport car carrying cargo to board through said opening, means for raising and lowering said lift table disposed at least at the four corners of said table, a ramp which extends between said lift table and said wharf, said ramp having a base, means for supporting the base of said ramp on said lift table, lift cable means for moving said ramp up and down along said opening, tilt cable means for pivoting said ramp about said base, first detecting means having an output for detecting the tilt angle of said ramp, second detecting means having an output for detecting the horizontality of said lift table, and control means receiving said outputs from said first and second detecting means for controlling the action of said raising and lowering means so as to respectively maintain the tilt angle of said ramp and the horizontality of said lift table within set predetermined limits.

6. A loading and unloading system as defined in claim 5, wherein said ramp is made to close said opening by driving said lift cable means and said tilt cable means.

7. A loading and unloading system which loads and unloads cargo loaded on a pallet between a wharf and a ship provided with an opening, a deck above said opening and a hold below said opening, by means of a transport car which enters and leaves the ship via said opening, said system comprising:

a rectangular lift table inside the ship to allow said transport car carrying cargo to board through said opening, means for raising and lowering said lift table disposed at least at the four corners of said table, a ramp which extends between said lift table and said wharf, said ramp having a base, means for supporting the base of said ramp on said lift table, first detecting means having an output for detecting the tilt angle of said ramp, second detecting means having an output for detecting the horizontality of said lift table, control means receiving said output from said first and second detecting means for controlling the action of said raising and lowering means so as to respectively maintain the tilt angle of said ramp and the horizontality of said lift table within set predetermined limits, an opening formed in said lift table which allows the passage of said pallet, a pair of pallet support means arranged in the lift table opening for supporting said pallet, said pallet support means being arranged facing each other such that they can be rotated downwards, and hydraulic cylinder means for rotating said pallet support means.

8. A loading and unloading system which loads and unloads cargo loaded on a pallet between a wharf and a ship provided with an opening, a deck above said opening and a hold below said opening, by means of a transport car which enters and leaves the ship via said opening, said system comprising:

a rectangular lift table inside the ship to allow said transport car carrying cargo to board through said opening, means for raising and lowering said lift table disposed at least at the four corners of said table, a ramp which extends between said lift table and said wharf, said ramp having a base, means for supporting the base of said ramp on said lift table, first detecting means having an output for detecting the tilt angle of said ramp, second detecting means having an output for detecting the horizontality of said lift table, control means receiving the output from said first and second detecting means for controlling the action of said raising and lowering means so as to respectively maintain the tilt angle of said ramp and the horizontality of said lift table within set predetermined limits, an opening formed in said lift table which allows the passage of said pallet, a pair of pallet support means arranged in the lift table opening for supporting said pallet, said pallet support means being arranged facing each other such that they can be rotated downwards, hydraulic cylinder means for rotating said pallet support means, a pair of pallet trucks which move parallel to one another inside said ship hold, platform means provided on said pallet trucks for supporting said pallet and which rotate about vertical axes, and jack means for lifting said platform means.

9. A loading and unloading system as defined in claim 2 wherein said extendable ramp supports include a ramp support member movable between a support position and a withdrawn position, and cylinder means on said lift table operable to move said ramp support member between said support position and said withdrawn position, said ramp support member pivotably supporting said pins when said ramp support member is in said support position, said ramp support member being displaced from said pins when said ramp support member is in said withdrawn position.

10. A loading and unloading system as defined in claim 9 further comprising ramp lift means for moving said ramp up and down, said ship having vertically disposed guide means, said ramp having guide parts guided in said guide means to thereby guide said pins along a vertical guide path as said ramp lift means moves said ramp up and down, said ramp support member having receiving means for receiving said pins, said receiving means being disposed in said path when said ramp support member is in said support position, said receiving means being displaced from said path when said ramp support member is in said withdrawn position.

* * * * *